US009666011B2

(12) United States Patent
Tosaka et al.

(10) Patent No.: US 9,666,011 B2
(45) Date of Patent: May 30, 2017

(54) CASH PROCESSING APPARATUS

(71) Applicant: Oki Electric Industry Co., Ltd., Tokyo (JP)

(72) Inventors: Yoshiyuki Tosaka, Tokyo (JP); Shinji Ohara, Tokyo (JP); Masashi Kashiwabuchi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 14/649,913

(22) PCT Filed: Oct. 17, 2013

(86) PCT No.: PCT/JP2013/078124
§ 371 (c)(1),
(2) Date: Jun. 4, 2015

(87) PCT Pub. No.: WO2014/097727
PCT Pub. Date: Jun. 26, 2014

(65) Prior Publication Data

US 2016/0240031 A1 Aug. 18, 2016

(30) Foreign Application Priority Data

Dec. 20, 2012 (JP) ..... 2012-278389

(51) Int. Cl.
*G07D 11/00* (2006.01)

(52) U.S. Cl.
CPC ..... *G07D 11/0081* (2013.01); *G07D 11/0018* (2013.01)

(58) Field of Classification Search
CPC ..... G07F 19/20; G07F 7/04; G07F 19/205; G07D 11/0081; G07D 11/0009; G07D 11/0018; G07D 11/0006; G06Q 20/1085; G06Q 20/18
USPC ..... 235/379
See application file for complete search history.

(56) References Cited

U.S. PATENT DOCUMENTS

| | | | | |
|---|---|---|---|---|
| 5,628,258 | A | 5/1997 | Zwahlen et al. | |
| 2002/0092727 | A1 | 7/2002 | Kato | |
| 2006/0283685 | A1* | 12/2006 | Cousin | G07D 1/02 194/217 |

FOREIGN PATENT DOCUMENTS

| | | | |
|---|---|---|---|
| CN | 101676961 | A | 3/2010 |
| JP | S62-157994 | A | 7/1987 |
| JP | H01-121993 | A | 5/1989 |
| JP | H05332067 | A | 12/1993 |
| JP | H-07-168962 | A | 4/1995 |

(Continued)

*Primary Examiner* — Jamara Franklin
(74) *Attorney, Agent, or Firm* — Rabin & Berdo, P.C.

(57) ABSTRACT

Provided is a money processing device whereby it is possible to alleviate a deterioration in security when a storage unit is extracted. A money processing device comprises: a deposit/withdrawal part which is disposed upon one end side of a device main body in the longitudinal direction which faces a customer, and whereby money is either deposited or withdrawn; and storage units which are disposed to be removable with respect to the device main body and which store money. The storage units are extracted from the device main body at a location which is removed from the customer. The storage units are disposed to be removable with respect to the device main body from the other end side in the longitudinal direction.

4 Claims, 17 Drawing Sheets

(56) References Cited

FOREIGN PATENT DOCUMENTS

| | | | |
|---|---|---|---|
| JP | 2001-093022 | A | 4/2001 |
| JP | 2002-260057 | A | 9/2002 |
| JP | 2009-289100 | A | 12/2009 |

* cited by examiner

CASH PROCESSING APPARATUS

TECHNICAL FIELD

The present invention relates to a cash processing apparatus having a storage part for storing cash.

BACKGROUND ART

Cash processing apparatuses represented by counter cash processing machines are installed at counters or the like in branches of financial institutions.

The cash processing apparatuses are used for deposit or withdrawal transactions of banknotes or coins and the like. It is possible to perform deposit or withdrawal transactions on cash inserted by an employee or a customer.

In the following Patent Literature 1, a cash processing apparatus for performing a deposit process of storing banknotes inserted into a deposit port in a stacker after the banknotes are temporarily held in a temporary holding part and a withdrawal process of separating the banknotes stored in a storage part and conveying the separated banknotes to a withdrawal port is disclosed.

CITATION LIST

Patent Literature

Patent Literature 1: JP 2001-93022A

SUMMARY OF INVENTION

Technical Problem

In the cash processing apparatus, various types of maintenance (for example, replacement of the storage part or the like), repairs, and the like are performed. In this case, an employee extracts a cassette which is the storage part from an apparatus main body and replaces the extracted cassette with a new cassette. Incidentally, the storage part may be extracted in front of a customer according to a configuration of the cash processing apparatus. In this case, because the storage part is exposed to a customer, an internal mechanism is revealed and there is a possibility of impairment of security.

Therefore, the present invention has been made in view of the aforementioned problem, and an objective of the present invention is to provide a new and improved cash processing apparatus capable of suppressing the degradation of security when a storage part is extracted.

Solution to Problem

According to the first aspect of the present invention in order to achieve the above-mentioned object, there is provided a cash processing apparatus includes a deposit/withdrawal part provided on one end in a longitudinal direction of an apparatus main body facing a customer and configured to insert or discharge cash; and a storage part provided to be detachable from the apparatus main body and configured to store the cash, wherein the storage part is extracted from the apparatus main body at a position away from the customer.

Also in the cash processing apparatus, the storage part may be provided to be drawn from the other end in the longitudinal direction of the apparatus main body, and storage part may be extracted after being drawn from the other end.

Also in the cash processing apparatus, the deposit/withdrawal part may be provided to be drawn from the one end in the longitudinal direction of the apparatus main body.

Also in the cash processing apparatus, the storage part may be positioned below the deposit/withdrawal part, and the storage part and the deposit/withdrawal part may be drawn together.

Also in the cash processing apparatus, the cash processing apparatus may further include an opening/closing door configured to be opened and closed on the other end in the longitudinal direction, and the storage part may be drawn from the other end while the opening/closing door is open.

Also in the cash processing apparatus, the cash processing apparatus may be attached to an installation stand movable toward the position away from the customer, the storage part may be provided to be drawn from the one end in the longitudinal direction of the apparatus main body, and when the installation stand has moved to the position, the storage part may be extracted after being drawn from the one end.

Also in the cash processing apparatus, the cash processing apparatus may be installed such that a center portion in the longitudinal direction is held in a face-to-face counter, and the storage part may be drawn from the one end after the deposit/withdrawal part positioned on one side when viewed from the face-to-face counter has moved to the other side when viewed from the face-to-face counter in association with movement of the installation stand.

According to another aspect of the present invention in order to achieve the above-mentioned object, there is provided a cash processing apparatus into which cash received from a customer facing one end in a longitudinal direction of an apparatus main body is inserted by a supplier facing the other end in the longitudinal direction of the apparatus main body. The cash processing apparatus may include a deposit port into which the cash is inserted by the supplier. The deposit port may be provided at a position of an upper side of the apparatus main body so that the deposit port is within a field of view of the customer giving the cash.

Also in the cash processing apparatus, the deposit port may be an opening directed upward on an upper surface side of the apparatus main body.

Also in the cash processing apparatus, the deposit port may be an opening toward the one end on an upper side surface of the apparatus main body.

Advantageous Effects of Invention

According to the above-described present invention, it is possible to suppress the degradation of security when a storage part is extracted.

BRIEF DESCRIPTION OF DRAWINGS

FIG. 2 is a diagram illustrating an example of an installation state of the banknote processing apparatus 10 in a branch of a financial institution or the like.

FIG. 6 is a diagram illustrating an example of an installation state of a banknote processing apparatus 900 according to a comparative example in a branch of a financial institution or the like.

FIG. 9A is a diagram illustrating an example of an installation state of the banknote processing apparatus 100 in a branch of a financial institution or the like.

FIG. 9B is a diagram illustrating an example of an installation state of the banknote processing apparatus 100 in a branch of a financial institution or the like.

FIG. 12 is a diagram illustrating an example of an installation state of a banknote processing apparatus 200 according to a third embodiment in a branch of a financial institution or the like.

DESCRIPTION OF EMBODIMENTS

Hereinafter, a preferred embodiment of the present invention will be described in detail with reference to the appended drawings. Note that, in the present description and the drawings, structural elements that have substantially the same function and structure are denoted with the same reference signs, and repeated explanation is omitted.

<1. First Embodiment>

(1-1. Internal Configuration Example of Cash Processing Apparatus)

An internal configuration example of a banknote processing apparatus 10 which is an example of the cash processing apparatus according to the first embodiment will be described with reference to FIG. 1.

Figure 1:
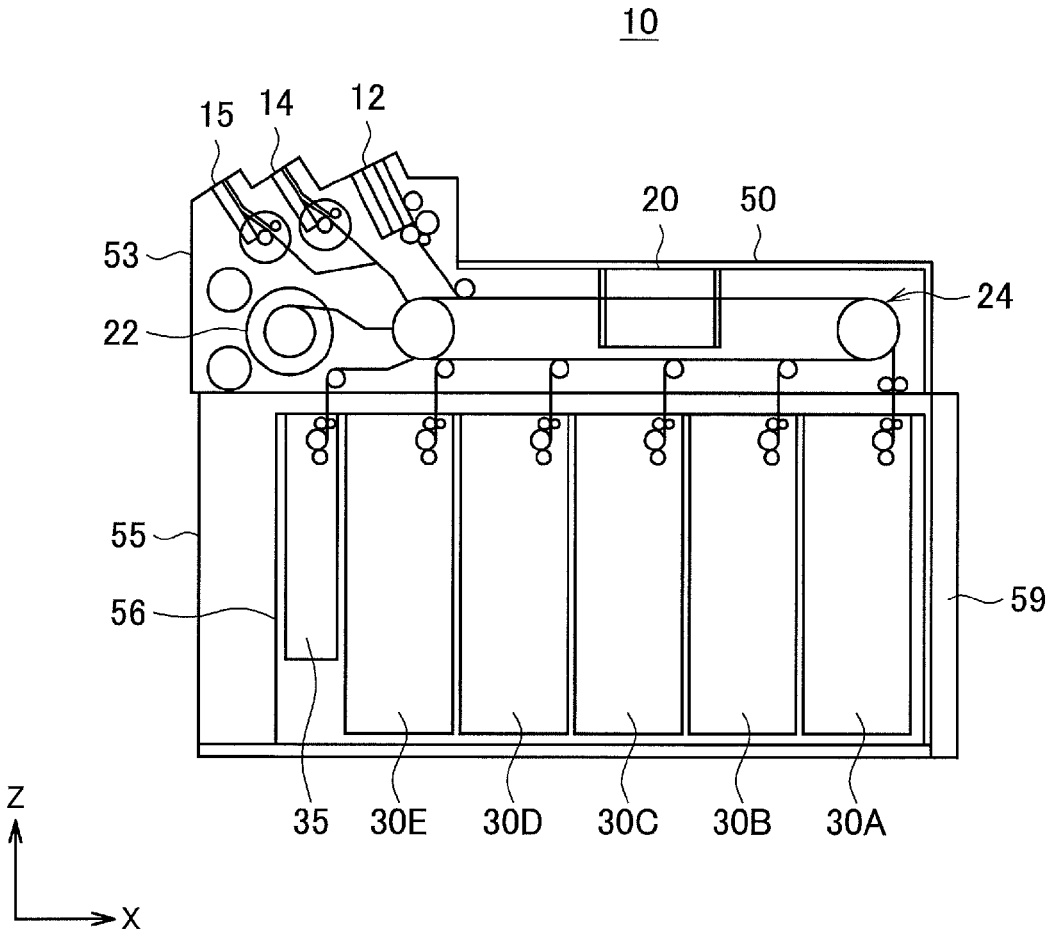
FIG. 1 is a diagram illustrating an example of an internal configuration of a banknote processing apparatus 10 according to a first embodiment.

FIG. 1 is a diagram illustrating an example of the internal configuration of the banknote processing apparatus 10 according to the first embodiment. The banknote processing apparatus 10 is installed in a branch of a financial institution or the like. The banknote processing apparatus 10 is a terminal that performs transactions of banknotes based on an operation by an employee or customer of the financial institution (hereinafter referred to as a customer or the like) who is an operator of the apparatus.

As illustrated in FIG. 1, the banknote processing apparatus 10 has a deposit port 12, a first withdrawal port 14, a second withdrawal port 15, a banknote recognition part 20, a temporary holding part 22, a conveyance part 24, banknote cassettes 30A to 30E, and a dedicated cassette 35 for storage. Also, the deposit port 12, the first withdrawal port 14, and the second withdrawal port 15 correspond to a deposit/withdrawal part and the banknote cassettes 30A to 30E correspond to a storage part.

The deposit port 12 is an inlet provided on one end in a longitudinal direction of an apparatus main body 50 facing the customer (a customer C illustrated in FIG. 2) and configured to allow the customer or the like to insert banknotes. A shutter (not illustrated) for opening and closing an opening portion may be configured to be provided in the deposit port 12. In addition, the deposit port 12 has a separating function of separating banknotes inserted in a bundle and feeding them one by one.

The first withdrawal port 14 and the second withdrawal port 15 are outlets from which banknotes to be received by the customer or the like are discharged (withdrawn). The first withdrawal port 14 and the second withdrawal port 15 have a stacking function of stacking the banknotes to be discharged. Although the two withdrawal ports are provided in the example illustrated in FIG. 1, the present invention is not limited thereto. For example, three or more withdrawal ports may be provided. Also, a shutter (not illustrated) for opening and closing an opening portion may be provided in each of the first withdrawal port 14 and the second withdrawal port 15.

A banknote recognition part 20 discriminates passing banknotes one by one. Movement directions of the banknotes corresponds to two directions, and the banknote recognition part 20 can discriminate the banknotes conveyed from a direction of the side of the deposit port 12 and the banknotes conveyed from an opposite direction. Specifically, the banknote recognition part 20 discriminates denomination, authenticity (genuine/counterfeit), physical condition (good/damaged), a traveling state (normal/abnormal) and the like of a banknote conveyed through a conveyance path, and makes a normal determination or a rejection determination on the passing banknote.

In the present specification, a genuine note is a note discriminated as a banknote, and a counterfeit note is a note that is not discriminated as a banknote. A note in good condition is a note discriminated as suitable for deposit/withdrawal among banknotes discriminated as genuine notes, and a damaged note is a note discriminated as unsuitable for deposit/withdrawal among the banknotes discriminated as the genuine notes. In addition, the rejection determination is made based on factors such as a counterfeit note, a damaged note (a note with dirt, damage, an abnormal external profile, or the like), and traveling abnormality (skewed banknotes, overlapping travel, or the like). In addition, rejected banknotes may include, for example, banknotes (for example, 2000 yen notes or 5000 yen notes) which are not handled as deposit banknotes, or foreign currency banknotes.

The temporary holding part 22 has both a banknote separating function and a banknote stacking function. For example, the temporary holding part 22 temporarily stacks banknotes separated from the deposit port 12 and discriminated as normal by the banknote recognition part 20 in a deposit transaction. Banknotes stacked in the temporary holding part 22 are fed out in the case of successful completion of a transaction such as confirmation of deposited banknotes in an account record and are conveyed to the banknote cassettes 30A to 30E and the like through the banknote recognition part 20. Also, the temporary holding part 22 may be configured in a stacking type in which banknotes are stacked to sequentially overlap or a drum type in which banknotes are sequentially wound and stored.

The conveyance part 24 includes conveyance paths, conveyance rollers for conveying banknotes, and a drive mechanism for driving the conveyance rollers, and conveys the banknotes one by one. The drive mechanism, for example, drives the conveyance roller by rotating a DC servomotor, a pulse motor, or the like.

The banknote cassettes 30A to 30E are banknote storage parts capable of storing banknotes according to denomination, and have both a banknote stacking function and a banknote separating function. The banknote cassettes 30A to 30E may include a plurality of banknote cassettes for the same denomination. In addition, the banknote cassettes 30A to 30E may be configured with a structure that is detachable from the banknote processing apparatus 10 and can load banknotes to the banknote cassettes 30A to 30E by performing individual replacement.

The dedicated cassette 35 for storage only has a stacking function of stacking banknotes. In the dedicated cassette 35 for storage, banknotes separated from the banknote cassettes 30A to 30E are stacked or banknotes (rejected banknotes) discriminated as abnormal (rejection determination) by the banknote recognition part 20 are stacked. The dedicated cassette 35 for storage also has a structure that is detachable from the banknote processing apparatus 10 and can collect the banknotes by performing replacement.

Figure 2:
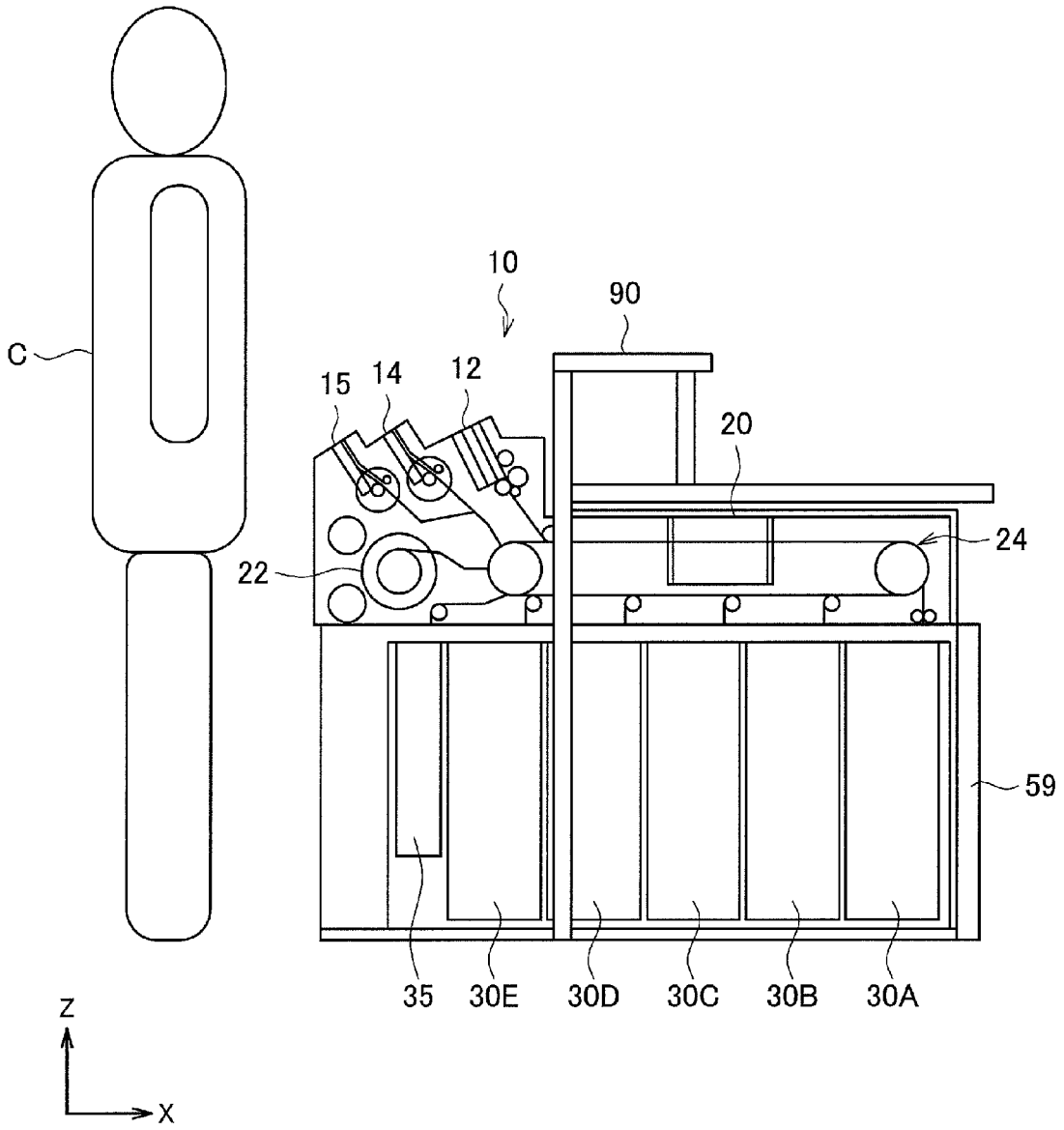

In the installation in branches of financial institutions or the like, the above-described banknote processing apparatus 10 is positioned between a customer and an employee who face each other in a state in which a counter 90 illustrated in FIG. 2, which is an example of a face-to-face counter, is between the customer and the employee. Thereby, the customer and the employee can operate the banknote processing apparatus 10.

FIG. 2 is a diagram illustrating an example of an installation state of the banknote processing apparatus 10 in a branch of a financial institution or the like. In FIG. 2, the banknote processing apparatus 10 is installed below the counter 90 of the branch or the like. Specifically, the banknote processing apparatus 10 is installed to have a center portion of a longitudinal direction (a direction X of FIG. 2) held in the counter 90. Then, the deposit port 12 and the withdrawal ports 14 and 15 are disposed on the side of a customer C so that the customer C inserts deposit banknotes into the deposit port 12 or the customer extracts withdrawal banknotes from the first withdrawal port 14 or the second withdrawal port 15.

Next, a process of the above-described banknote processing apparatus 10 will be described. The banknote processing apparatus 10, for example, performs a deposit process and a withdrawal process. The deposit process is a process of stacking banknotes of the deposit port 12 on the banknote cassettes 30A to 30E. The withdrawal process is a process of stacking the banknotes of the banknote cassettes 30A to 30E on the first withdrawal port 14 or the second withdrawal port 15.

In the deposit process, banknotes inserted into the deposit port 12 by the customer or the like are first separated and fed one by one. The fed banknotes are conveyed to the banknote recognition part 20 through the conveyance part 24. Thereafter, the banknote recognition part 20 discriminates the banknotes, and a normal banknote indicated by a discrimination result is conveyed and stacked to the temporary holding part 22. On the other hand, an abnormal banknote (rejected banknote) indicated by the discrimination result by the banknote recognition part 20 is stacked on the first withdrawal port 14 or the second withdrawal port 15. The banknotes stacked on the temporary holding part 22 are separated one by one and conveyed to the banknote recognition part 20. Normal banknotes indicated by the discrimination result by the banknote recognition part 20 are stacked on the banknote cassettes 30A to 30E corresponding to denominations. On the other hand, abnormal banknotes indicated by the discrimination result by the banknote recognition part 20 as notes with dirt and damage, folded banknotes, or abnormally traveling banknotes such as skewed banknotes are stacked on the dedicated cassette 35 for storage.

In the withdrawal process, first, the banknotes from the banknote cassettes 30A to 30E are separated and fed one by one according to an amount of money designated by the customer or the like. The fed banknotes are conveyed to the banknote recognition part 20 through the conveyance part 24. Thereafter, the banknote recognition part 20 discriminates the banknotes, and the normal banknotes indicated by the discrimination result are stacked on the first withdrawal port 14 or the second withdrawal port 15. Specifically, for example, according to denominations of the normal banknotes or the number of normal banknotes to be withdrawn, the banknotes are selectively stacked (collected) on the first withdrawal port 14 or the second withdrawal port 15. On the other hand, the abnormal banknotes indicated by the discrimination result, that is, banknotes incapable of being paid to the customer, are stacked on the dedicated cassette 35 for storage.

(1-2. Drawing of Upper and Lower Units)

For the banknote processing apparatus 10, various types of maintenance (for example, banknote jam elimination), repairs, and the like are performed by an employee. Therefore, as illustrated in FIG. 1, the banknote processing apparatus 10 has the upper unit 53 and the lower unit 56 capable of being drawn from or inserted into the apparatus main body 50. The lower unit 56 is positioned below the upper unit 53.

The upper unit 53 includes the deposit port 12, the first withdrawal port 14, the second withdrawal port 15, the banknote recognition part 20, the temporary holding part 22, and the conveyance part 24 described above. When a banknote jam has occurred in the conveyance part 24 or the like or when the upper unit 53 is repaired, the employee draws the upper unit 53, extracts a jammed banknote, or repairs the upper unit 53. The upper unit 53 is drawn or inserted along a slide rail (not illustrated) of an upper housing 52 of the apparatus main body 50.

Figure 3:
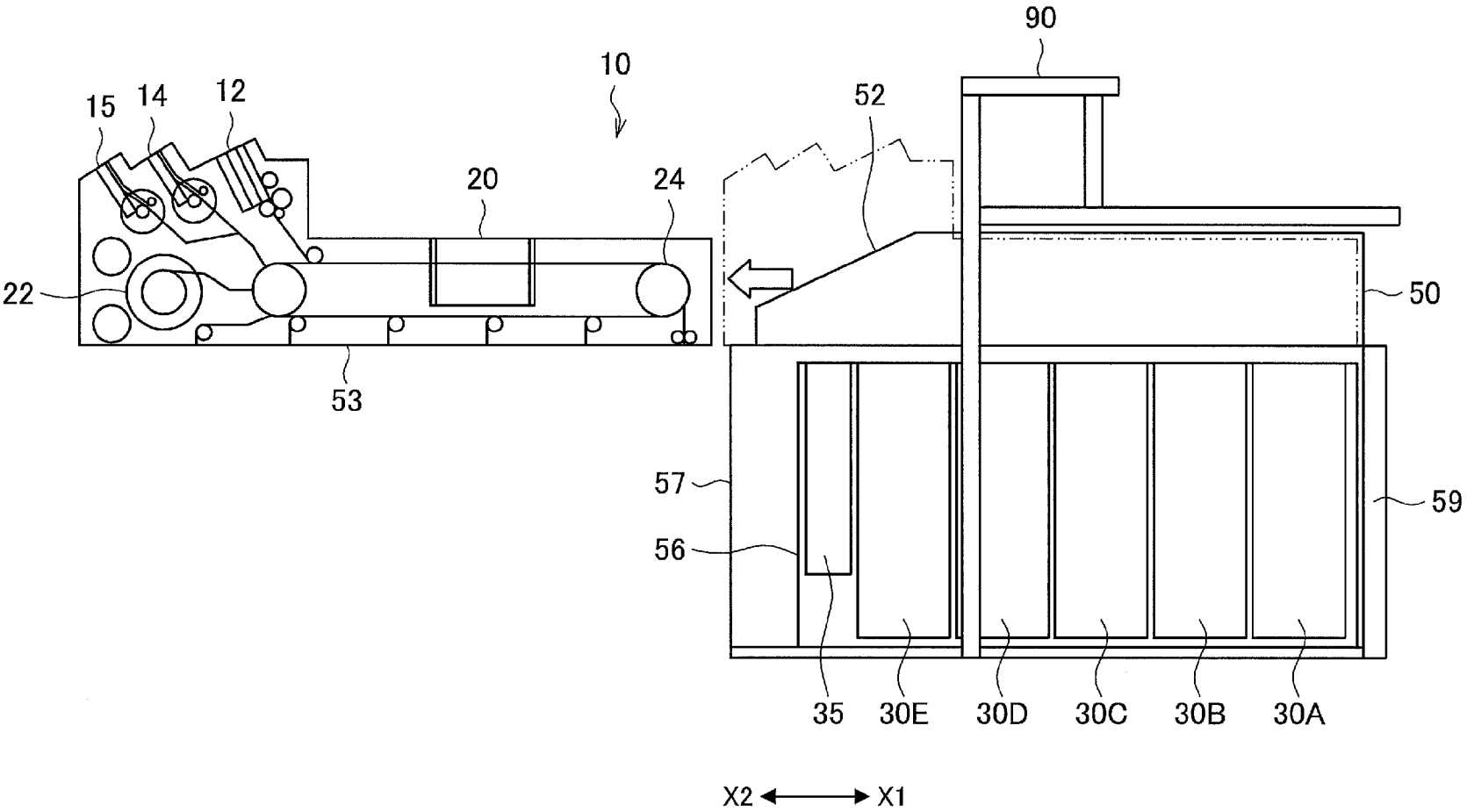
FIG. 3 is a schematic diagram illustrating a drawing direction of an upper unit 53.

FIG. 3 is a schematic diagram illustrating a drawing direction of the upper unit 53. As illustrated in FIG. 3, the upper unit 53 is drawn from one end in the longitudinal direction of the apparatus main body 50 in a direction X2 (customer side) and inserted into the apparatus main body 50 in a direction Xl.

The lower unit 56 includes the banknote cassettes 30A to 30E and the dedicated cassette 35 for storage described above. When the cassette is replaced to collect/supplement the banknotes of the banknote cassettes 30A to 30E or the dedicated cassette 35 for storage or when a banknote jam occurs in the banknote cassettes 30A to 30E or the dedicated cassette 35 for storage, the employee draws the lower unit 56 to replace the cassette within the lower unit 56 or remove the jammed banknote.

In the lower unit 56, the banknote cassettes 30A to 30E and the dedicated cassette 35 for storage are set to be detachable. The lower unit 56 is drawn or inserted along the slide rail (not illustrated) of a lower housing 55. Then, when the lower unit 56 is drawn, the banknote cassettes 30A to 30E and the storage-dedicated cassettes 35 can be replaced.

Figure 4A:
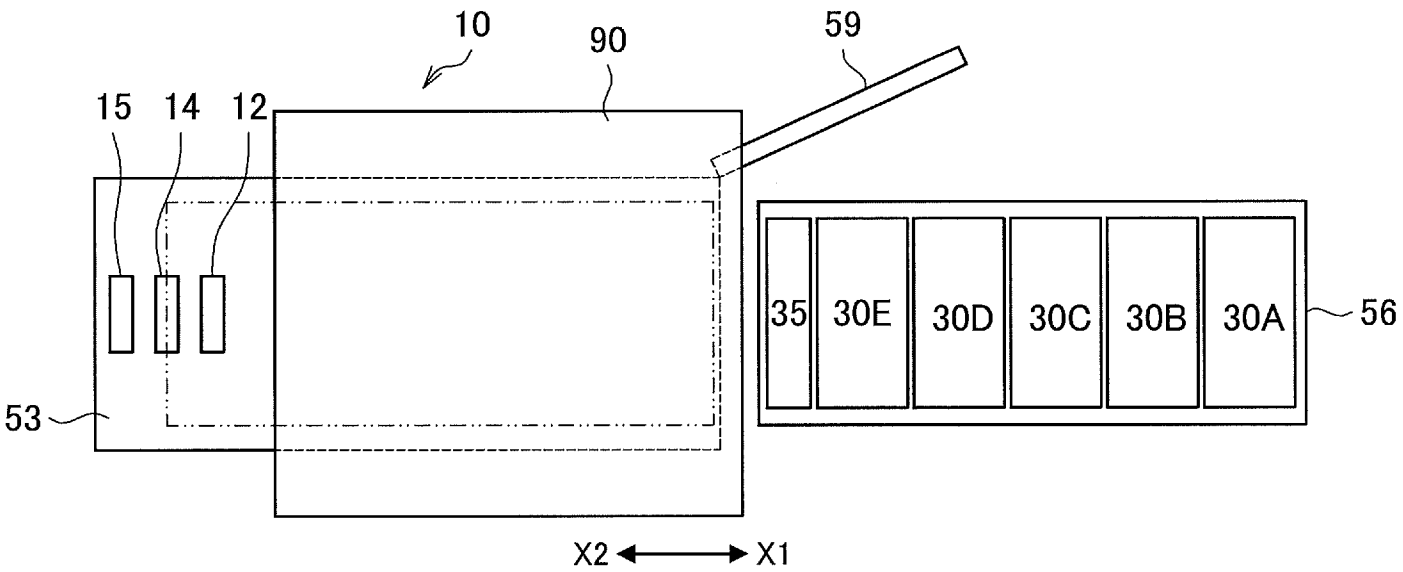
FIG. 4A is a schematic diagram illustrating a drawing direction of a lower unit 56.
Figure 4B:
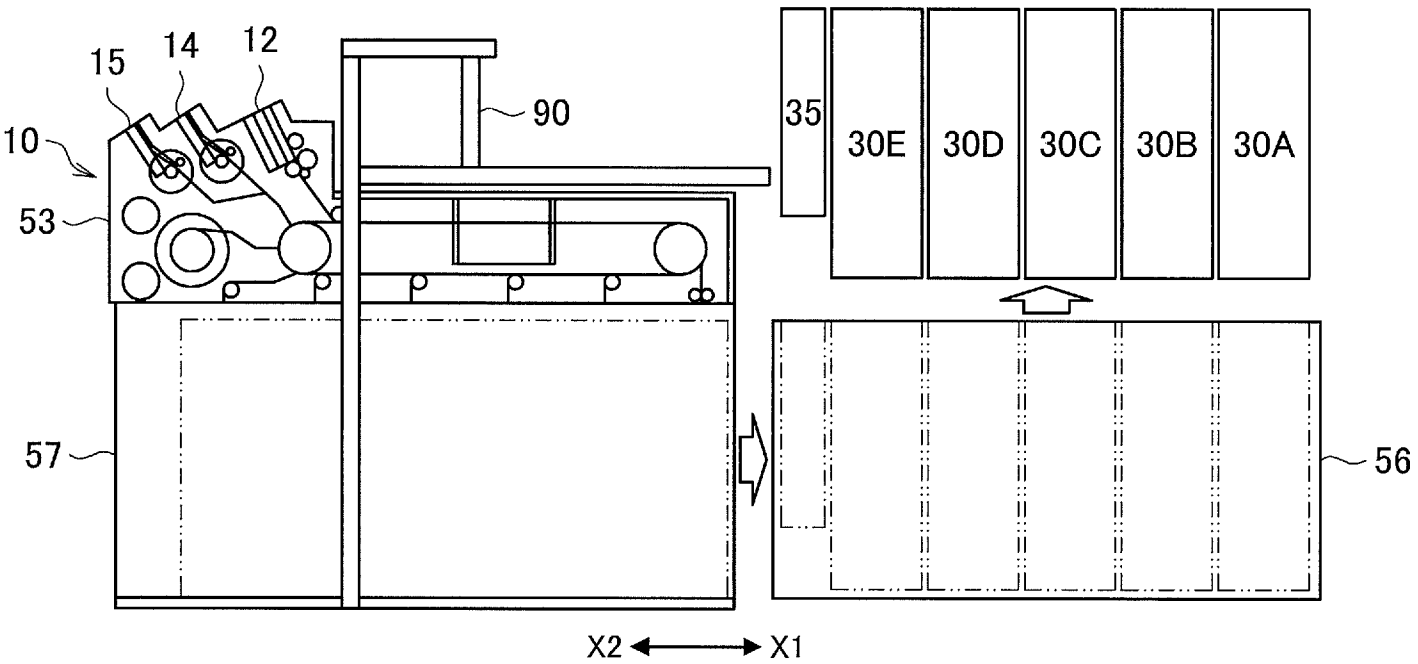
FIG. 4B is a schematic diagram illustrating a drawing direction of the lower unit 56.

FIGS. 4A and 4B are schematic diagrams illustrating a drawing direction of the lower unit 56 in the first embodiment. FIG. 4A is a diagram of the banknote processing apparatus 10 viewed from above and FIG. 4B is a diagram of the banknote processing apparatus 10 viewed from the front. The lower unit 56 is drawn from the other end in the longitudinal direction of the apparatus main body 50 in the direction X1 (a direction away from the customer) and inserted into the apparatus main body 50 in the direction X2. In this manner, in the first embodiment, the drawing direction of the upper unit 53 and the drawing direction of the lower unit 56 are opposite.

Figure 5:
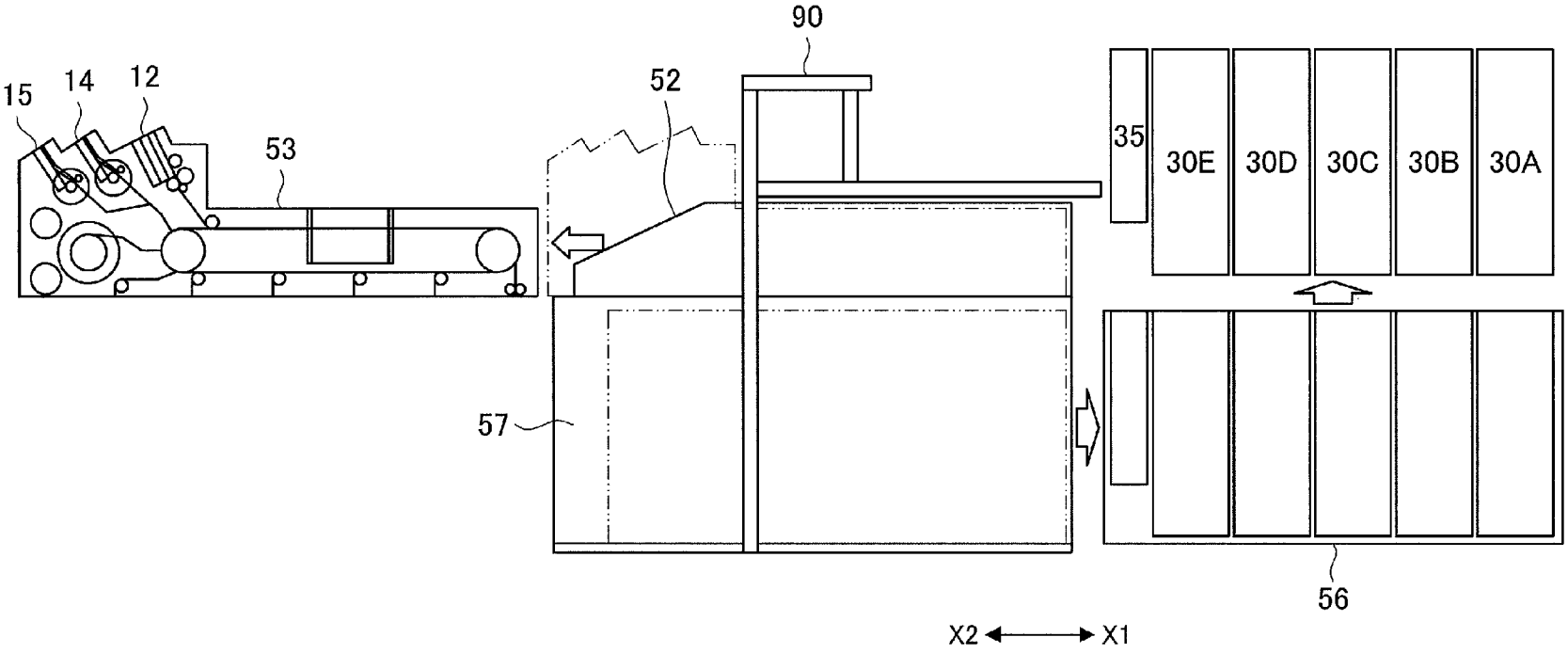
FIG. 5 is a diagram illustrating an example in which the upper unit 53 and the lower unit 56 are drawn together.

Although the upper unit 53 and the lower unit 56 are separately drawn in the above description, the present invention is not limited thereto. For example, as illustrated in FIG. 5, the upper unit 53 and the lower unit 56 may be drawn together.

When the upper unit 53 and the lower unit 56 are drawn together, maintainability is improved because maintenance or the like is performed on the two units. In this embodiment, the apparatus main body 50 is stable because the lower housing 55 is a thick metallic housing and the upper unit 53 and the lower unit 56 can be drawn together. FIG. 5 is a diagram illustrating an example in which the upper unit 53 and the lower unit 56 are drawn together.

On the other end in the longitudinal direction of the banknote processing apparatus 10, an opening/closing door 59 (see FIG. 1) is provided. The opening/closing door 59 is locked under normal circumstances, and unlocked when the lower unit 56 is drawn. Then, in an open state of the opening/closing door 59 as illustrated in FIG. 4A, the lower unit 56 is drawn. Also, in FIG. 4B, the opening/closing door 59 is omitted for convenience of description.

Here, a flow until the banknote cassettes 30A to 30E and the dedicated cassette 35 for storage are drawn will be described. First, the employee draws the lower unit 56 to a near side (a position away from the customer) after unlocking the opening/closing door 59 and opening the opening/closing door 59. Next, the employee moves the banknote cassettes 30A to 30E or the dedicated cassette 35 for storage upward to extract the banknote cassettes 30A to 30E or the dedicated cassette 35 for storage from the lower unit 56. In this manner, in the first embodiment, the banknote cassettes 30A to 30E and the dedicated cassette 35 for storage are drawn at a position away from the customer. Thereafter, the employee ends the replacement of the banknote cassettes 30A to 30E or the dedicated cassette 35 for storage by setting a new cassette in the lower unit 56 and inserting the new cassette into the apparatus main body 50.

(1-3. Effectiveness of First Embodiment)

The effectiveness of the banknote processing apparatus 10 according to the first embodiment will be described in contrast to comparative examples illustrated in FIGS. 6 and 7.

Figure 6:
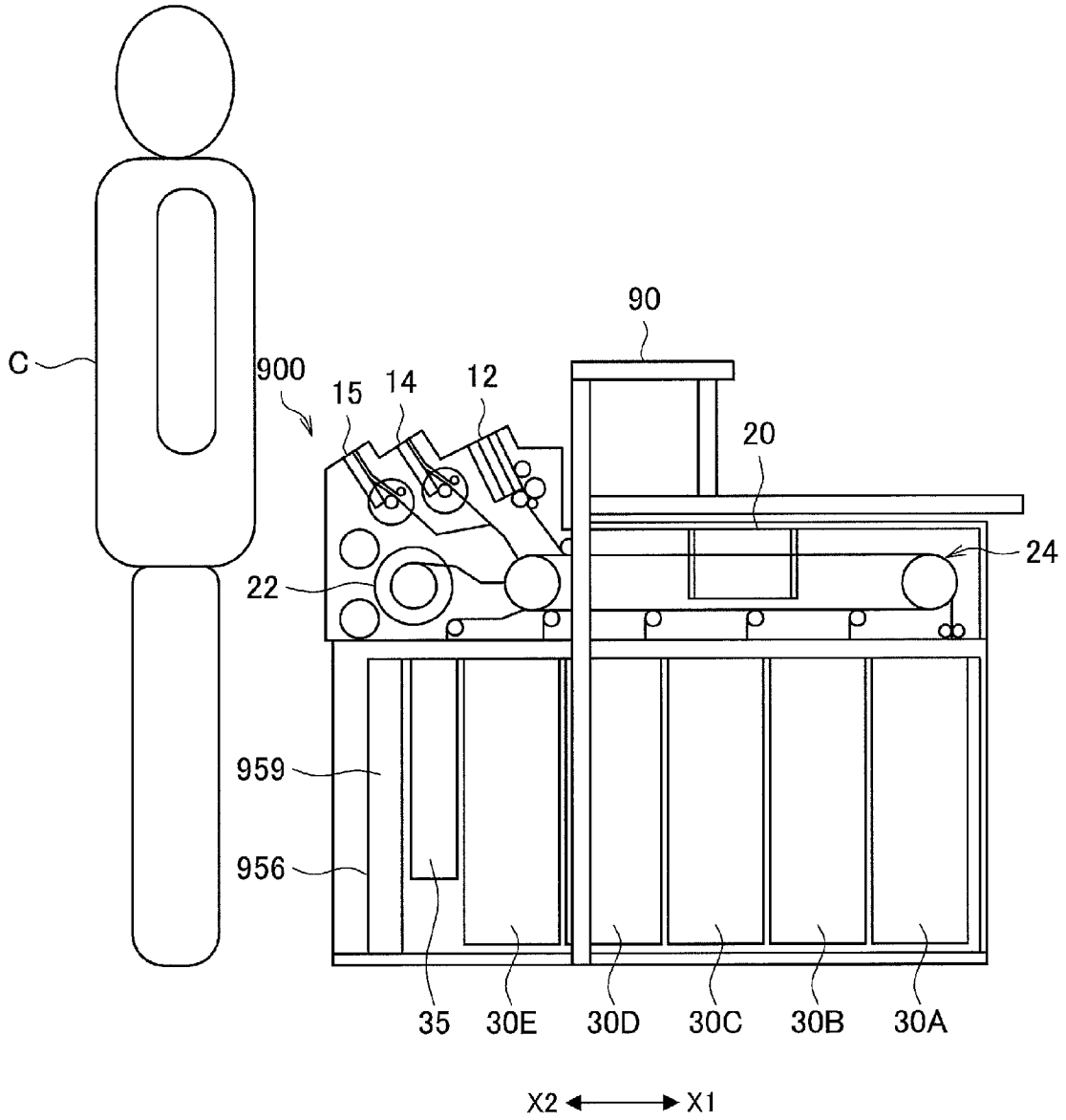

FIG. 6 is a diagram illustrating an example of an installation state of a banknote processing apparatus 900 according to a comparative example in a branch of a financial institution or the like. Although a configuration of an upper portion of the banknote processing apparatus 900 is similar to that of the banknote processing apparatus 10 illustrated in FIG. 1, a configuration of a lower portion of the banknote processing apparatus 900 is different from that of the banknote processing apparatus 10. In the comparative example, the opening/closing door 959 is positioned on the side of the customer C and the lower unit 956 is drawn to the side of the customer C.

Figure 7:
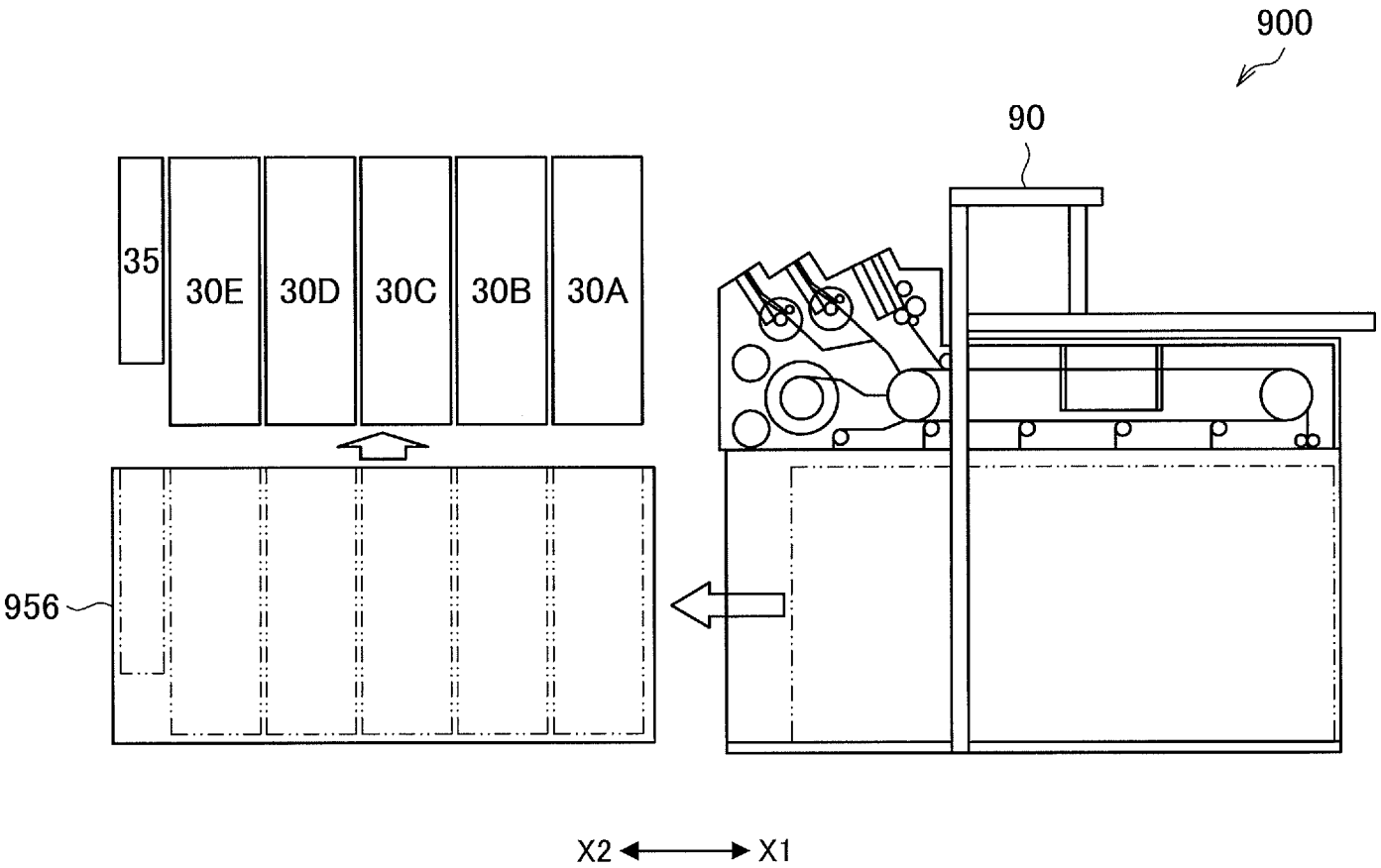
FIG. 7 is a schematic diagram illustrating drawing of a lower unit in the banknote processing apparatus 900 according to the comparative example.

FIG. 7 is a schematic diagram illustrating drawing of the lower unit 956 in the banknote processing apparatus 900 according to the comparative example. In a comparative example, for example, the employee draws the lower unit 956 after the opening/closing door 959 has been unlocked and the opening/closing door 959 has been opened in front of the customer by moving to the side of the customer C when the banknote cassettes 30A to 30E or the dedicated cassette 35 for storage are replaced. Also, in FIG. 7, for convenience of description, the opening/closing door 959 is omitted.

In the case of the comparative example, the employee performs an operation of replacing a cassette or removing a jammed banknote in front of the customer C. Thus, the banknote cassettes 30A to 30E or the dedicated cassette 35 for storage are exposed to the customer and there is a risk of robbery or a possibility of an internal mechanism or housing structure of the banknote processing apparatus 900 and a viewpoint or locking position of a door thereof being revealed. In addition, there is a risk of theft if the customer can reach a jammed banknote in a blind spot of the employee.

For this, in the first embodiment, the banknote cassettes 30A to 30E or the dedicated cassette 35 for storage are extracted at a position away from the customer C by drawing the lower unit 56 to a side opposite the customer C. In this case, it is possible to prevent the customer from being able to reach the jammed banknote because it is possible to separate the lower unit 56 from the customer. In addition, it is difficult for the customer to visually recognize internal structures of the banknote cassettes 30A to 30E or the dedicated cassette 35 for storage and it is possible to improve security because the counter 90 blocks the field of view of the customer who views the lower unit 56 when the lower unit 56 is drawn.

Although an example of the banknote processing apparatus 10 has been described above as a cash processing apparatus, the present invention is not limited thereto. For example, the cash processing apparatus may be a coin processing apparatus in which deposit/withdrawal and storage of coins are possible. Even in this case, it is difficult for the customer to visually recognize an internal structure of the coin processing apparatus and it is possible to improve security by drawing a lower unit including a storage part for storing coins in a direction away from the customer.

<2. Second Embodiment>

Figure 8:
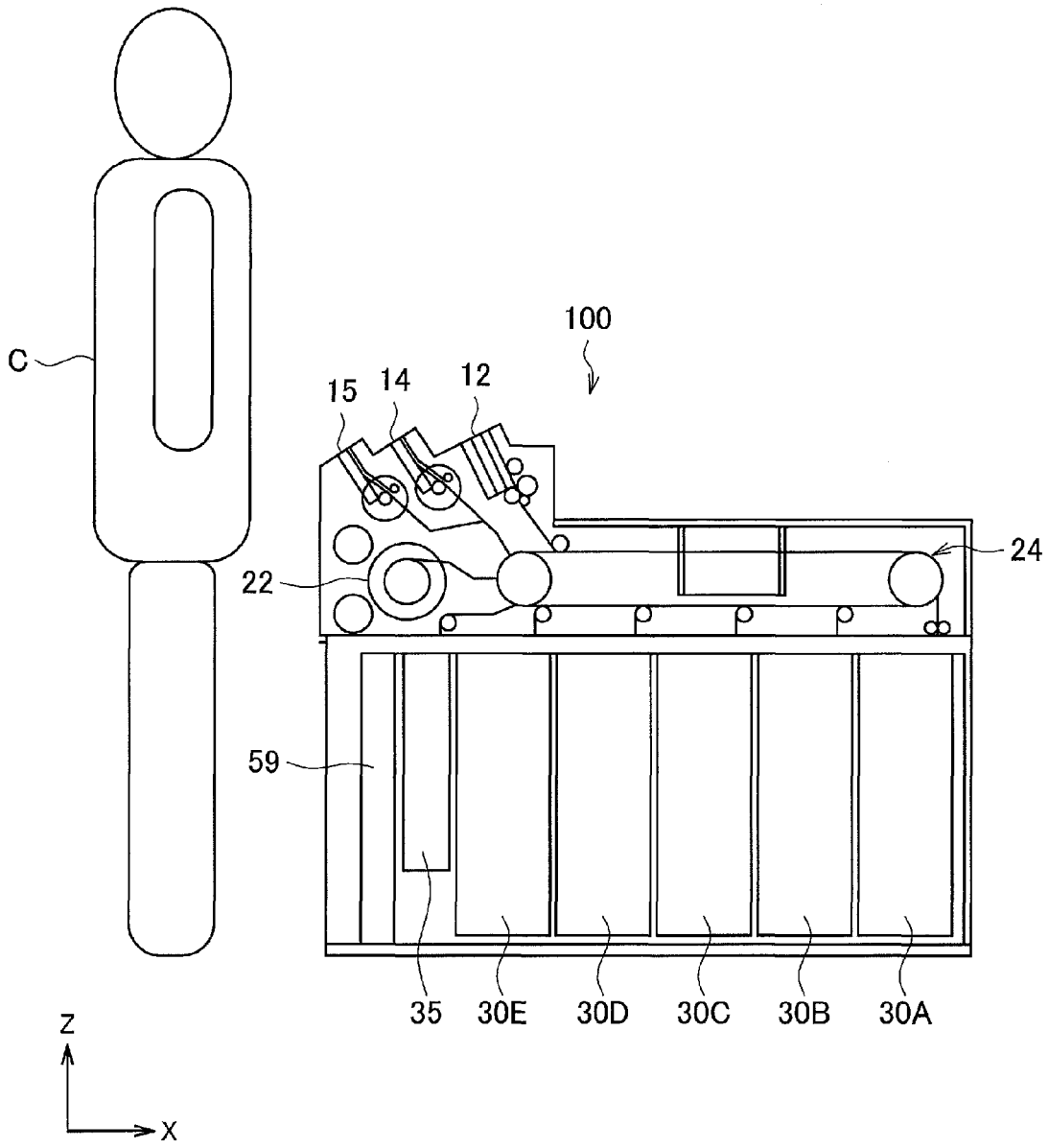
FIG. 8 is a diagram illustrating an example of an internal configuration of a banknote processing apparatus 100 according to a second embodiment.

FIG. 8 is a diagram illustrating an example of an internal configuration of a banknote processing apparatus 100 according to the second embodiment. Although the opening/closing door 59 is provided on the employee's side as illustrated in FIG 1 in the first embodiment, the opening/closing door 59 is provided on the customer's side as illustrated in FIG. 8 in the second embodiment. In addition, although the lower unit 56 is drawn from the other end in the longitudinal direction of the apparatus main body in the direction X1 in the first embodiment, the lower unit 56 is drawn from the one end in the longitudinal direction of the apparatus main body in the direction X2 in the second embodiment.

Figure 9A:
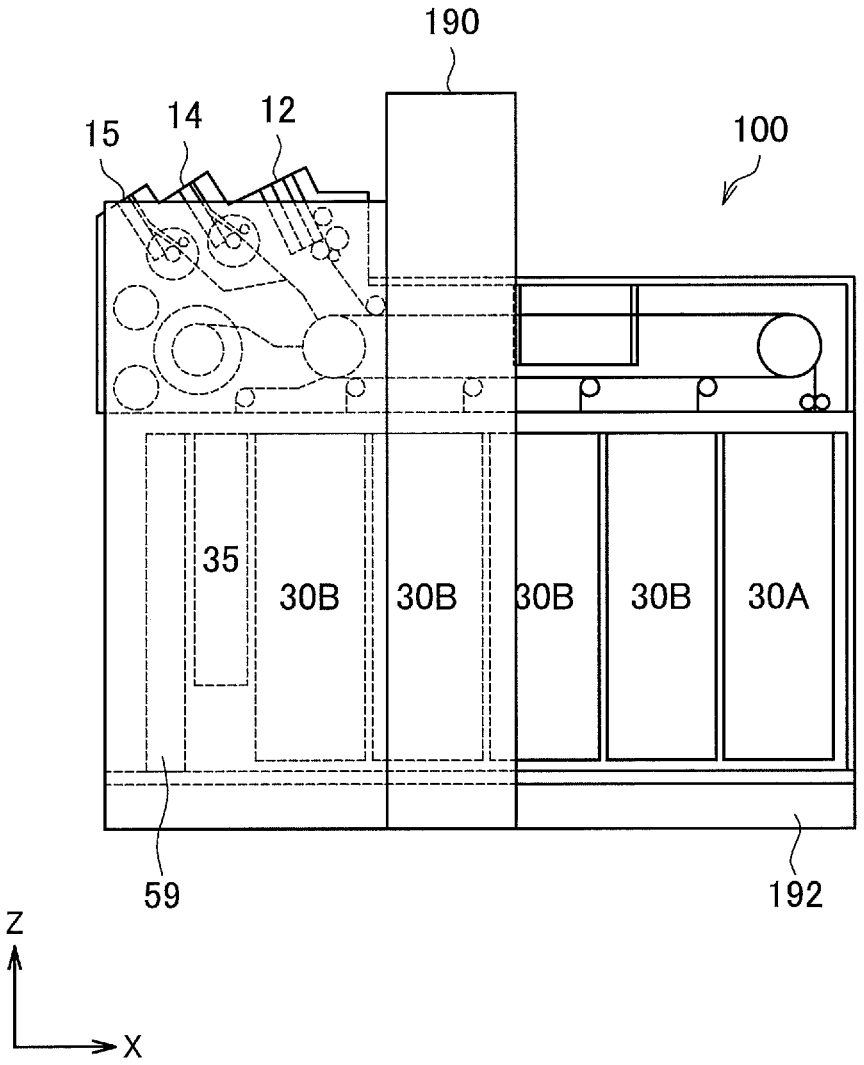
Figure 9B:
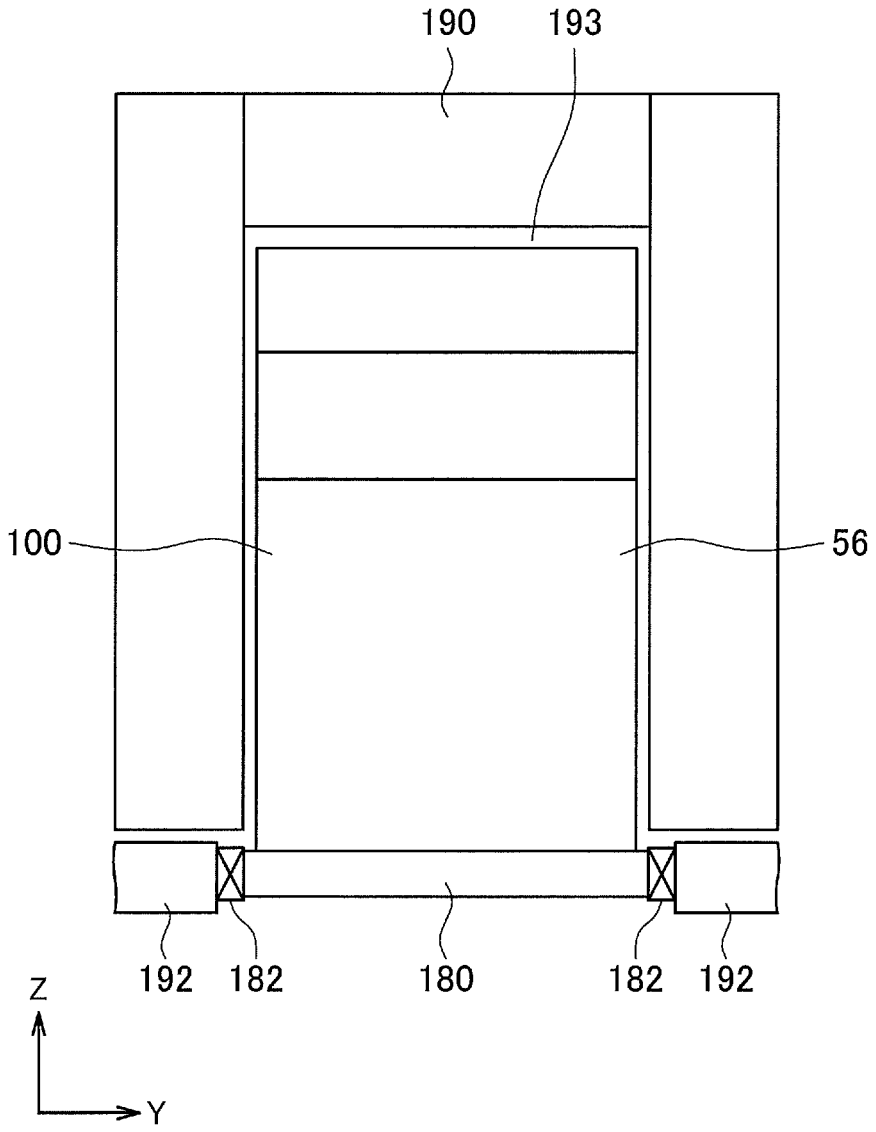

FIGS. 9A and 9B are diagrams illustrating an example of an installation state of the banknote processing apparatus 100 in a branch of a financial institution or the like. As illustrated in FIG. 9B, the banknote processing apparatus 100 is attached (specifically, fixed) to an installation stand 180 below the counter 190. The installation stand 180 has slide mechanisms 182 movable in the directions X1 and X2 while the banknote processing apparatus 100 is held to a base 192 of the counter below the counter 190. For example, the installation stand 180 is configured to move to a position away from the customer by moving in the direction X1.

The counter 190 according to the second embodiment has an opening portion 193 which is not interfered with when the banknote processing apparatus 100 moves in the direction X1 as illustrated in FIG. 9B.

Figure 10:
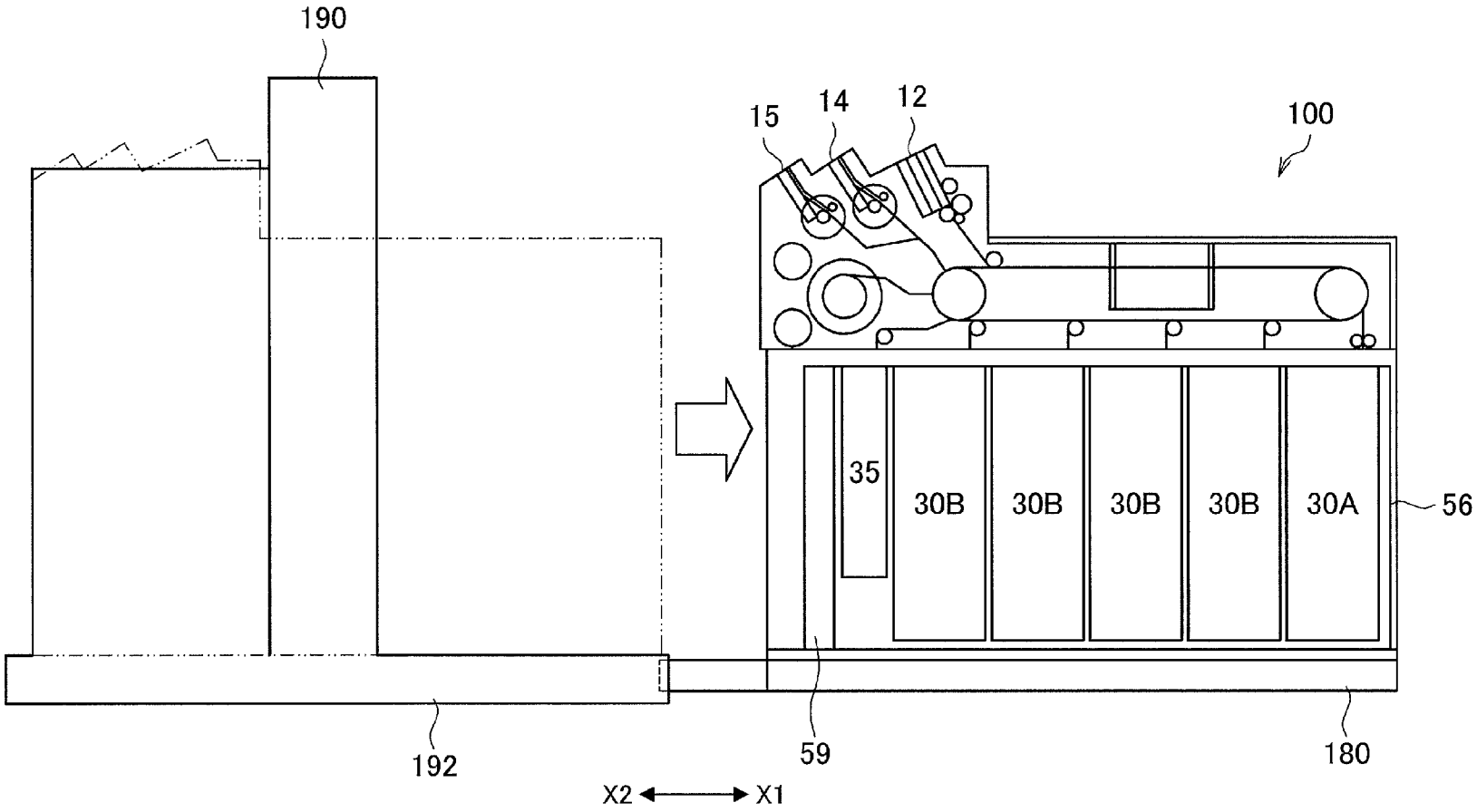
FIG. 10 is a schematic diagram illustrating a state in which an installation stand 180 holding the banknote processing apparatus 100 has moved in a direction X1.
Figure 11:
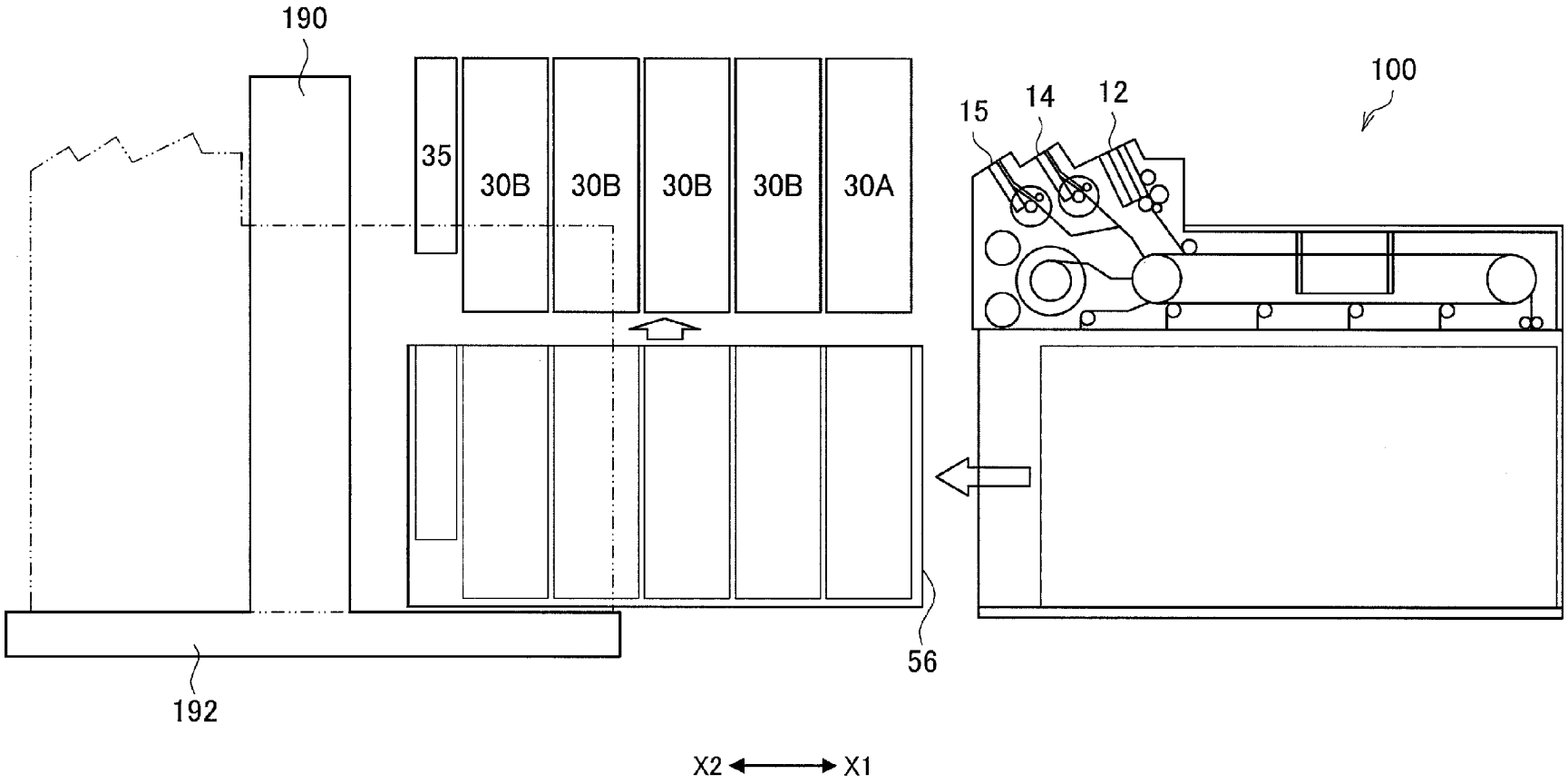
FIG. 11 is a schematic diagram illustrating a flow in which banknote cassettes 30A to 30E and a dedicated cassette 35 for storage are extracted.

Next, the extraction of the banknote cassettes 30A to 30E and the dedicated cassette 35 for storage in the second embodiment will be described with reference to FIGS. 10 and 11. FIG. 10 is a schematic diagram illustrating a state in which the installation stand 180 holding the banknote processing apparatus 100 has moved in the direction X1. FIG. 11 is a schematic diagram illustrating a flow in which the banknote cassettes 30A to 30E and the dedicated cassette 35 for storage are extracted.

First, as illustrated in FIG. 10, the employee moves the installation stand 180 to which the banknote processing apparatus 100 is fixed in the direction X1 (a position away from the customer). Thereby, a deposit port 12, a first withdrawal port 14, and a second withdrawal port 15 are positioned on an opposite side of the counter 190. A movement amount of the installation stand 180 in the direction X1 is an amount at which a main body portion drawn in the direction X2 does not pass through the opening portion 193 of the counter 190 (see FIG. 11).

Next, the employee is positioned between the banknote processing apparatus 100 positioned at a position away from the customer and the counter 190 to draw the lower unit 56 from one end of the apparatus main body 50 in the direction X2 as illustrated in FIG. 11 after unlocking the opening/closing door 59 and opening the opening/closing door 59. Next, the employee raises and extracts the banknote cassettes 30A to 30E or the dedicated cassette 35 for storage.

Even in the second embodiment, the banknote cassettes 30A to 30E or the dedicated cassette 35 for storage are extracted at a position away from the customer by moving the installation stand 180 in the direction X1. Even in this case, it is possible to prevent the customer from being able to reach the jammed banknote because it is possible to separate the lower unit 56 of the banknote processing apparatus 100 from the customer. In addition, it is difficult for the customer to visually recognize internal structures of the banknote cassettes 30A to 30E or the dedicated cassette 35 for storage and it is possible to improve security because the counter 190 blocks the field of view of the customer who views the lower unit 56 when the main body portion is drawn.

<3. Third Embodiment>

In the first and second embodiments, the customer inserts deposit banknotes into the deposit port 12 and extracts withdrawal banknotes from the first withdrawal port 14 or the second withdrawal port 15. On the other hand, in the third embodiment, a banknote processing apparatus is installed in a branch of a financial institution so that an employee who is a supplier inserts deposit banknotes into a deposit port and extracts withdrawal banknotes from a withdrawal port.

Figure 12:
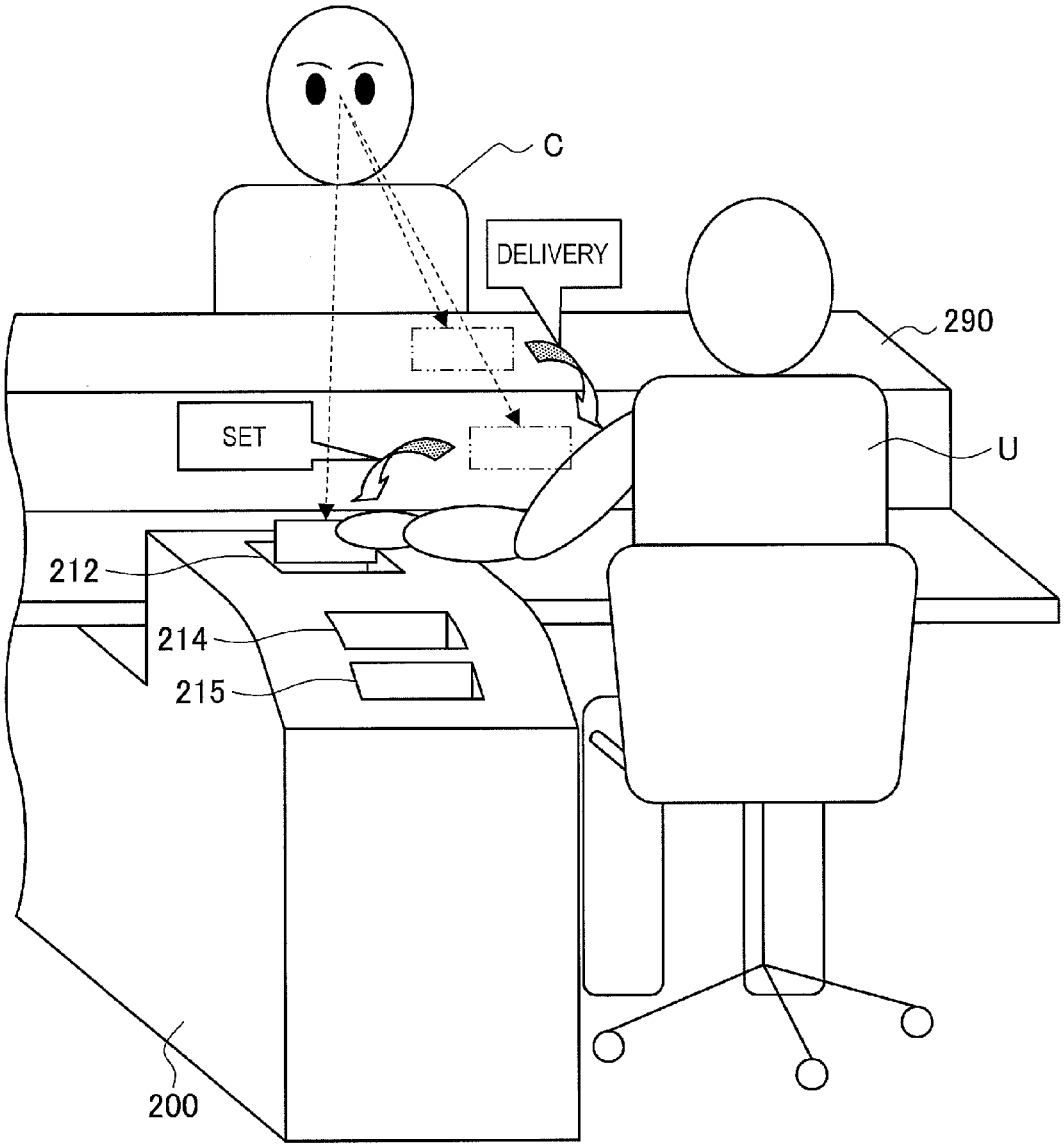

FIG. 12 is a diagram illustrating an example of an installation state of a banknote processing apparatus 200 according to the third embodiment in a branch of a financial institution or the like. The banknote processing apparatus 200 is installed below a counter 290 between a customer C and an employee U who face each other. Then, in the third embodiment, the customer faces one end in a longitudinal direction in which a deposit port 212, a first withdrawal port 214, and a second withdrawal port 215 are provided and the employee U faces the other end in the longitudinal direction of the banknote processing apparatus 200.

In this case, the customer visiting the branch gives banknotes to the employee U sitting on an opposite side of the counter 290. The employee U inserts the received banknotes into the deposit port 212 of the banknote processing apparatus 200. The inserted banknotes are fed into the banknote processing apparatus 200, the number of banknotes is counted, types of the banknotes are determined, and the banknotes are stored in a cassette or the like.

Incidentally, in the banknote processing apparatus 200 according to the third embodiment, a position of the deposit port 212 is set so that the customer C easily identifies the employee's action of inserting the banknotes into the deposit port. Specifically, as illustrated in FIG. 11, the deposit port 212 is provided at a position of an upper side of the banknote processing apparatus 200 so that the deposit port 212 is within a field of view of the customer giving the banknotes.

Figure 13:
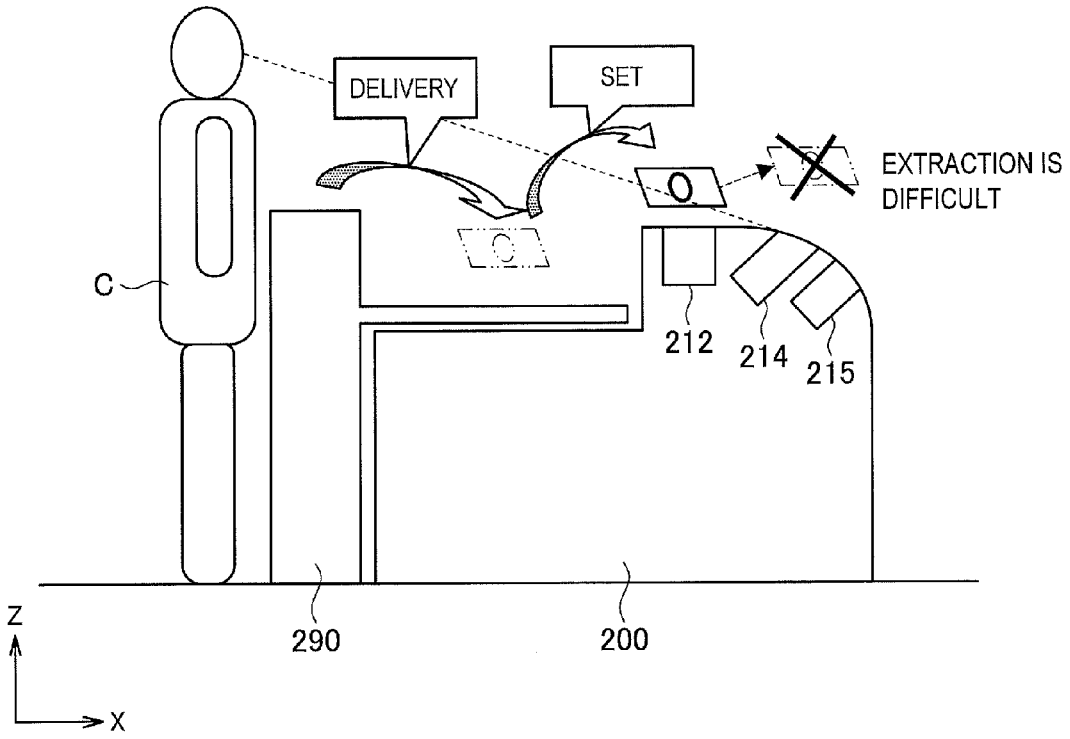
FIG. 13 is a diagram illustrating a relationship between a flow of insertion of banknotes into a deposit port and a line of sight of a customer in the third embodiment.
Figure 14:
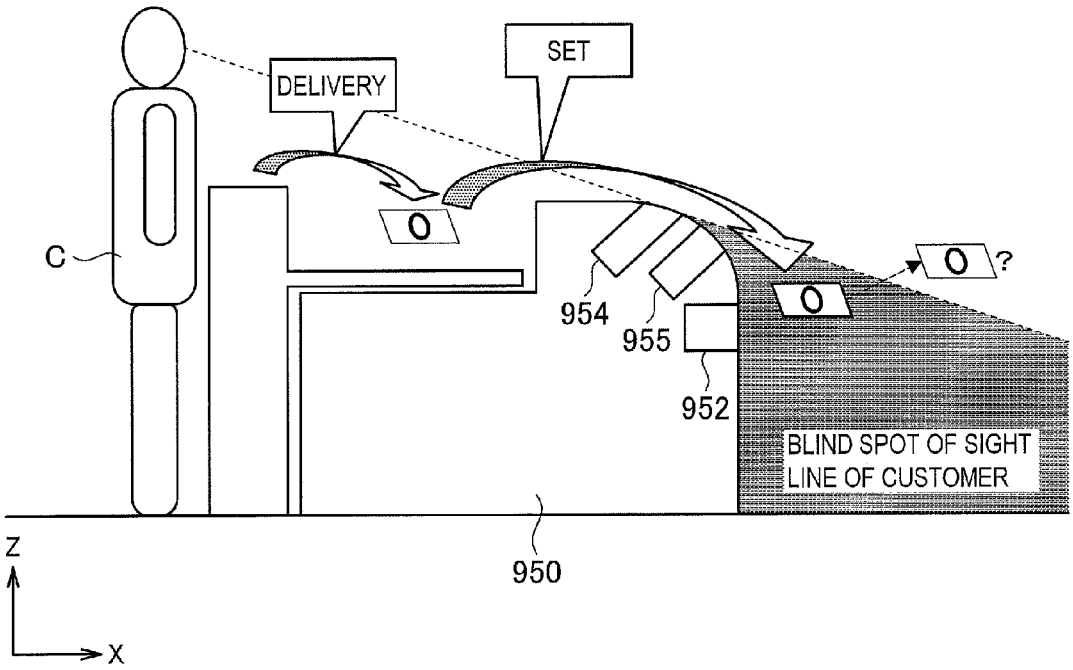
FIG. 14 is a diagram illustrating a comparative example.

FIG. 13 is a diagram illustrating a relationship between a flow of insertion of banknotes into the deposit port 212 and a line of sight of a customer in the third embodiment. As illustrated in FIG. 13, the deposit port 212 is an opening formed on the upper surface side of the banknote processing apparatus 200 so as to face upward at an angle at which the deposit port 212 is not covered by the banknote processing apparatus 200 when viewed by the customer C standing on a rear side of the banknote processing apparatus 200. Also, the first withdrawal port 214 and the second withdrawal port 215 are disposed to be closer to an employee side than the FIG. 14 is a diagram illustrating a comparative example. In a banknote processing apparatus 950 according to the comparative example, a deposit port 952 is disposed at a front surface side facing an employee. When the employee inserts banknotes received from the customer into the deposit port 952 in this configuration, the banknotes are covered by the banknote processing apparatus 950 and positioned in a blind spot of the sight line of the customer. In this case, even when the employee extracts a banknote to be inserted into the deposit port 952, it is difficult for the customer to identify the extracted banknote. Thus, for example, when a total amount of banknotes given by the customer to the employee is different from a total amount of banknotes inserted into the deposit port 952, there is a possibility of a problem occurring with the customer.

On the other hand, when the deposit port 212 is provided at a position illustrated in FIG. 13, an arm of the employee passes through only an upper side of the banknote processing apparatus 200 when a banknote received from the customer is inserted into the deposit port 212. Thereby, because it is possible to prevent the banknote from being covered by the banknote processing apparatus 200, the customer can continuously identify motion until the employee inserts the banknote into the deposit port 212. As a result, it is possible to prevent a problem from occurring with the customer.

Figure 15:
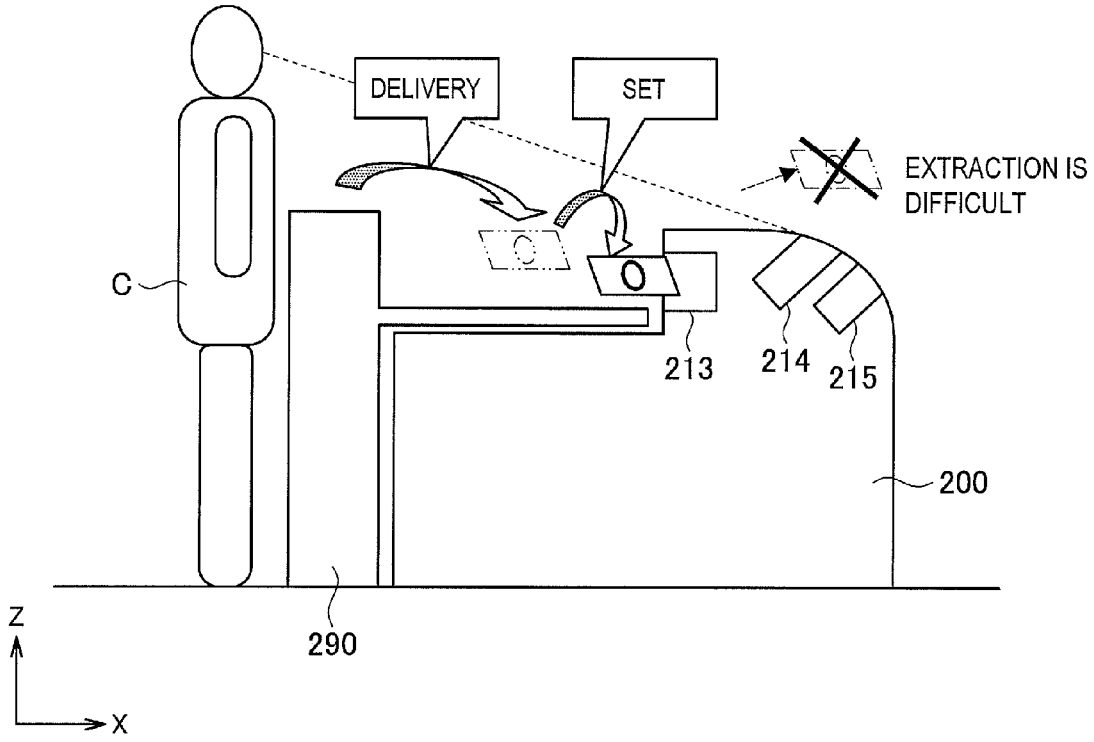
FIG. 15 is a diagram illustrating a modified example of the banknote processing apparatus 200 according to the third embodiment.

FIG. 15 is a diagram illustrating a modified example of the banknote processing apparatus 200 according to the third embodiment. In the modified example, a deposit port 213 is disposed on an upper side surface of a banknote processing apparatus 200 so that the deposit port 213 is directed to a rear side (customer side). A position of the deposit port 213 is a position within a field of view of the customer standing on the rear side of the banknote processing apparatus 200.

Even in the case of the modified example, an arm of the employee passes through only an upper side of the banknote processing apparatus 200 when a banknote received from the customer is inserted into the deposit port 213. Thereby, because it is possible to prevent the banknote from being covered by the banknote processing apparatus 200, the customer C can continuously identify motion until the employee inserts the banknote into the deposit port 213. As a result, it is possible to prevent a problem from occurring with the customer.

Although the preferred embodiments of the present invention have been described in detail with reference to the appended drawings, the present invention is not limited thereto. It is obvious to those skilled in the art that various modifications or variations are possible insofar as they are within the technical scope of the appended claims. It should be understood that such modifications or variations are also within the technical scope of the present invention.

REFERENCE SIGNS LIST

10 banknote processing apparatus
12 deposit port
14 first withdrawal port
15 second withdrawal port
30A to 30E banknote cassette
35 dedicated cassette for storage
50 apparatus main body
53 upper unit
55 lower housing
56 lower unit
59 opening/closing door
180 installation stand
212, 213 deposit port
C customer

The invention claimed is:

1. A cash processing apparatus, comprising:

an apparatus main body having opposing first and second ends in a longitudinal direction;

a deposit/withdrawal part provided to face a customer and being configured to receive or discharge cash; and a storage part provided to be detachable from the apparatus main body and being configured to store the cash, wherein the storage part is adapted to be drawn out from only the first end in the longitudinal direction of the apparatus main body so that the storage part is away from the customer, the storage part being extractable after the storage part is drawn out from the apparatus main body, and the deposit/withdrawal part is adapted to be drawn out from only the second end in the longitudinal direction of the apparatus main body.

2. The cash processing apparatus according to claim 1, wherein the storage part is positioned below the deposit/withdrawal part, and wherein the storage part and the deposit/withdrawal part are drawn concurrently.

3. The cash processing apparatus according to claim 1, further comprising:

an opening/closing door configured to be opened and closed on the first end in the longitudinal direction, wherein the storage part is drawn from the first end while the opening/closing door is open.

4. The cash processing apparatus according to claim 1, further comprising:

a counter that is provided at a center portion of the apparatus main body in the longitudinal direction.

* * * * *